US010937279B1

(12) United States Patent
Workman

(10) Patent No.: US 10,937,279 B1
(45) Date of Patent: Mar. 2, 2021

(54) MULTI-TIERED PERSONAL WAGER CREATION AND OPEN WAGER MATCHING SYSTEM AND PEER-TO-PEER SPORTS BETTING PROCESSES

(71) Applicant: Elliott Workman, Leander, TX (US)

(72) Inventor: Elliott Workman, Leander, TX (US)

( * ) Notice: Subject to any disclaimer, the term of this patent is extended or adjusted under 35 U.S.C. 154(b) by 0 days.

(21) Appl. No.: 16/424,210

(22) Filed: May 28, 2019

Related U.S. Application Data

(60) Provisional application No. 62/845,644, filed on May 9, 2019.

(51) Int. Cl.
*G07F 17/32* (2006.01)
*G06Q 50/34* (2012.01)

(52) U.S. Cl.
CPC ..... *G07F 17/3288* (2013.01); *G06Q 50/34* (2013.01); *G07F 17/3239* (2013.01)

(58) Field of Classification Search
CPC .. G07F 17/3288; G07F 17/3239; G06Q 50/34
See application file for complete search history.

(56) References Cited

U.S. PATENT DOCUMENTS 10,438,451 B2 * 10/2019 Amaitis ..... G07F 17/3244
10,515,516 B1 * 12/2019 Eckman ..... G07F 17/3276
2002/0155885 A1 * 10/2002 Shvili ..... G07F 17/3279 463/25
2003/0199315 A1 * 10/2003 Downes ..... G07F 17/3288 463/28
2012/0142411 A1 * 6/2012 Thompson ..... A63F 13/35 463/25
2012/0322540 A1 * 12/2012 Shechtman ..... G07F 17/3288 463/25
2019/0362601 A1 * 11/2019 Kline ..... G07F 17/3223

* cited by examiner

*Primary Examiner* — David L Lewis
*Assistant Examiner* — Ross A Williams
(74) *Attorney, Agent, or Firm* — Plager Schack LLP

(57) ABSTRACT

A peer-to-peer sports betting platform is disclosed. With the peer-to-peer sports betting platform, users can create bets and view open bets, but will not pay exorbitant fees to place bets. The peer-to-peer sports betting platform is tiered, based on how much money is won per bet. Users also get to create and define their own bets for other users to directly accept.

10 Claims, 7 Drawing Sheets

MULTI-TIERED PERSONAL WAGER CREATION AND OPEN WAGER MATCHING SYSTEM AND PEER-TO-PEER SPORTS BETTING PROCESSES

CLAIM OF BENEFIT TO PRIOR APPLICATION

This application claims benefit to U.S. Provisional Patent Application 62/845,644, entitled "A peer-to-peer sports betting platform," filed May 9, 2019. The U.S. Provisional Patent Application 62/845,644 is incorporated herein by reference.

BACKGROUND

Embodiments of the invention described in this specification relate generally to sports betting, and more particularly, to a multi-tiered personal wager creation and open wager matching system and to peer-to-peer sports betting processes.

In the conventional sports betting world, sports bettors pay ridiculous commission fees to bookies in order to engage in betting/wagering. The conventional options in the sports betting world precludes user from creating their own bets, instead requiring that they follow whatever the Vegas odds-makers create. That is, if a person want to bet online with a bookie or sports-book, the person is required to bet the lines created by Vegas odds-makers. If the person wants to change the lines, or the over/under, the person has to pay a premium for "points".

Therefore, what is needed is a low cost way to provide sports bettors enough freedom to bet whatever they want, creating and finding such bets, as well as determining the odds for bets, so that once a bet is created, the user and/or the bet can be matched to one or more other user(s) who are most likely to accept the bet.

BRIEF DESCRIPTION

Some embodiments of the invention include a novel multi-tiered personal wager creation and open wager matching system and novel peer-to-peer sports betting processes. In some embodiments, the peer-to-peer sports betting processes include a bet creation process and an open bets process for viewing all open bets. In some embodiments, users of the multi-tiered personal wager creation and open wager matching system create and makes bets at a marginal cost. In some embodiments, users of the multi-tiered personal wager creation and open wager matching system pay up to five percent commission and no more. In some embodiments, the multi-tiered personal wager creation and open wager matching system is tiered based on how much money is won per bet.

The preceding Summary is intended to serve as a brief introduction to some embodiments of the invention. It is not meant to be an introduction or overview of all inventive subject matter disclosed in this specification. The Detailed Description that follows and the Drawings that are referred to in the Detailed Description will further describe the embodiments described in the Summary as well as other embodiments. Accordingly, to understand all the embodiments described by this document, a full review of the Summary, Detailed Description, and Drawings is needed. Moreover, the claimed subject matters are not to be limited by the illustrative details in the Summary, Detailed Description, and Drawings, but rather are to be defined by the appended claims, because the claimed subject matter can be embodied in other specific forms without departing from the spirit of the subject matter.

BRIEF DESCRIPTION OF THE DRAWINGS

Having described the invention in general terms, reference is now made to the accompanying drawings, which are not necessarily drawn to scale, and wherein.

DETAILED DESCRIPTION

Figure 1:
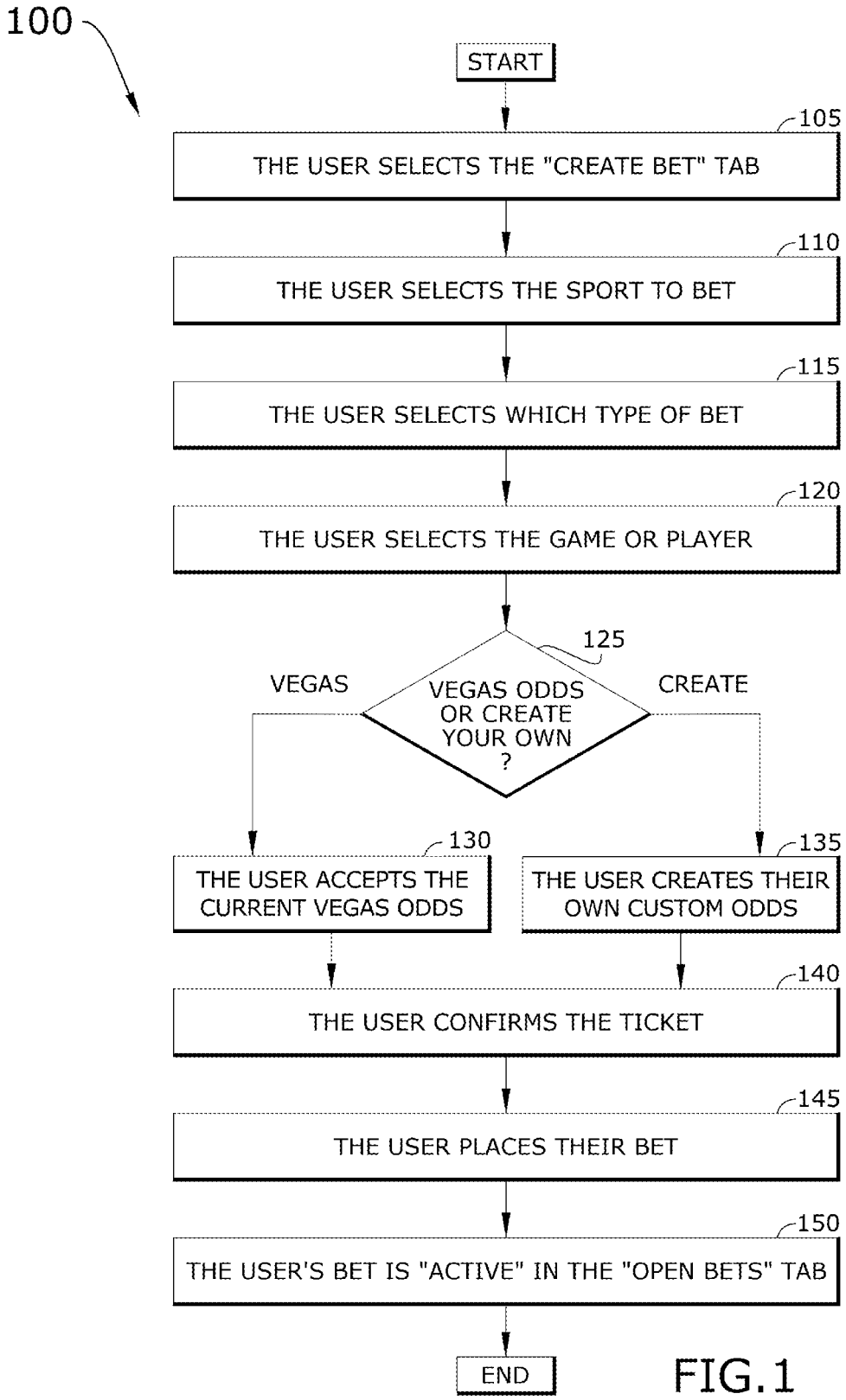
FIG. 1 conceptually illustrates a bet creation process in some embodiments.

In the following detailed description of the invention, numerous details, examples, and embodiments of the invention are described. However, it will be clear and apparent to one skilled in the art that the invention is not limited to the embodiments set forth and that the invention can be adapted for any of several applications.

Some embodiments of the invention include a novel multi-tiered personal wager creation and open wager matching system and novel peer-to-peer sports betting processes. In some embodiments, the peer-to-peer sports betting processes include a bet creation process and an open bets process for viewing all open bets. In some embodiments, users of the multi-tiered personal wager creation and open wager matching system create and makes bets at a marginal cost. In some embodiments, users of the multi-tiered personal wager creation and open wager matching system pay up to five percent commission and no more. In some embodiments, the multi-tiered personal wager creation and open wager matching system is tiered based on how much money is won per bet. For example, in a worst case scenario, if one of our users wins $50 against another user, we'd only take $2.50 (5%), which is significantly less than any other bookie/sports-book.

As stated above, in the conventional sports betting world, sports bettors pay ridiculous commission fees to bookies in order to engage in betting/wagering. The conventional options in the sports betting world precludes user from creating their own bets, instead requiring that they follow whatever the Vegas odds-makers create. That is, if a person want to bet online with a bookie or sports-book, the person is required to bet the lines created by Vegas odds-makers. If the person wants to change the lines, or the over/under, the person has to pay a premium for "points". Embodiments of the multi-tiered personal wager creation and open wager matching system described in this specification solve such problems by matching sports bettors with similar interests, thereby ensuring that the multi-tiered personal wager creation and open wager matching system does not serve as a bookie, but rather as a matching platform. In addition, the multi-tiered personal wager creation and open wager matching system minimizes fees and costs by taking only a very small commission percentage (i.e., no more than 5%) from the winner's total profit.

Embodiments of the multi-tiered personal wager creation and open wager matching system described in this specification differ from and improve upon currently existing options. In particular, some embodiments differ because there is no other peer-to-peer sports betting platform like the multi-tiered personal wager creation and open wager matching system. There are daily fantasy sport sites (DraftKings, FanDuel, etc.), but they provide different options and different services than the offerings of the multi-tiered personal wager creation and open wager matching system. Furthermore, the multi-tiered personal wager creation and open wager matching system is not a bookie-type entity or structure. Instead, the multi-tiered personal wager creation and open wager matching system just matches sports bettors with similar interests. The users get to determine what they bet, how much they bet, and the odds for said bet.

In addition, some embodiments of the multi-tiered personal wager creation and open wager matching system improve upon the conventional sports betting options by removing the costly middle layer of bookies and odds-makers. Specifically, the multi-tiered personal wager creation and open wager matching system supports a platform for users to directly make their own bets, set odds, etc., and publish those bets in an open pool of bets for users to search and accept (if interested in the bet/odds). The costs in the conventional betting regime are hefty and typically users pay a lot for such little profit. By way of example, the Patriots football team in the Superbowl were favored by 2.5, according to Vegas odds makers. Whether a person bet the Patriots or the Rams to cover the spread, the payout was automatically −115, meaning the person would have to risk $115 just to win $100. That's a steep cost and presents one of the problems in the conventional systems. But adding to this problem, most users understand that to begin with in gambling, a person must assume risks. In contrast, costs and risks are reduced when engaging in peer-to-peer wagering by way of the multi-tiered personal wager creation and open wager matching system since users do not pay bookies or odds makers, and at most, pay a trivial commission (e.g., up to, and not exceeding, 5%) to an entity that supports hardware and operation of the peer-to-peer sports betting platform hosted by the multi-tiered personal wager creation and open wager matching system. Furthermore, in some embodiments, the cost is tiered, based on how much money is won per bet, as described above.

The peer-to-peer sports betting platform, the multi-tiered personal wager creation and open wager matching system, and the peer-to-peer sports betting processes of the present disclosure may be comprised of the following elements. This list of possible constituent elements is intended to be exemplary only and it is not intended that this list be used to limit the peer-to-peer sports betting platform, the multi-tiered personal wager creation and open wager matching system, and the peer-to-peer sports betting processes of the present application to just these elements. Persons having ordinary skill in the art relevant to the present disclosure may understand there to be equivalent elements that may be substituted within the present disclosure without changing the essential function or operation of the peer-to-peer sports betting platform, the multi-tiered personal wager creation and open wager matching system, and the peer-to-peer sports betting processes.

1. Hardware computing devices that host the peer-to-peer sports betting platform (e.g., as a cloud-computing application service/platform).

2. Databases to store user-created bets, user details, etc.

3. Cloud service software (web server software) that provides visual interface(s) for users to interact with the peer-to-peer sports betting platform.

4. User software—including a mobile app that is installed and runs on mobile devices (personal mobile device, tablet computing device, smartphone, etc.) of the users and a client-side software application to run on computers/laptops of users.

5. An open wager search matching software engine that runs on a cloud server (same or different from the web server or the cloud server of the multi-tiered personal wager creation software engine) in connection with the web server and which matches sports bettors with similar interests and identifies open bets from user-created bets stored in the database.

6. A multi-tiered personal wager creation software engine that runs on a cloud server (same or different from the web server or the cloud server of the open wager search matching software engine)

7. Multiple network-accessible devices of sports bettors.

The peer-to-peer sports betting platform, the multi-tiered personal wager creation and open wager matching system, and the peer-to-peer sports betting processes of the present disclosure generally works by user interaction to create and make bets. For example, a new user will go to a website for the peer-to-peer sports betting platform and will register with name, email address, postal address, and payment information. Once they are fully set up, they will fill out all of the sports they are interested in betting on, as well as what kind of things they like to bet on (individual player props, over/unders, lines, etc.). Finally, they will put in a range of money that they are comfortable betting. Once complete, they will be fully registered and have two options—either (i) "create" their own bet and (ii) view "open bets" from searching the database. The open wager search matching software engine will process user interaction to suggest one or more open bets that pertain to the sports the user likes, the things the user likes to bet on, that also those open bets which fit within their budget range.

To make the peer-to-peer sports betting platform, the multi-tiered personal wager creation and open wager matching system, and the peer-to-peer sports betting processes of the present disclosure, a person may hire or be an experienced software engineer capable of building the software engines, the client-side software (and mobile apps), web server, etc., with appropriate systems engineering skills to fully deploy the databases and relevant hardware one which the software engines run. A person may also tap graphic design skills to provide suitable interfaces/user interfaces which allow the users of the multi-tiered personal wager creation and open wager matching system to efficiently engage in bet creation and bet viewing/searching interactions on the peer-to-peer sports betting platform.

To use the peer-to-peer sports betting platform, the multi-tiered personal wager creation and open wager matching system, and the peer-to-peer sports betting processes of the present disclosure, a user would interact with the peer-to-peer sports betting platform by network connection of their client-side device (e.g., mobile device, computer, tablet, etc.) to the cloud-based multi-tiered personal wager creation and open wager matching system. Once actively registered and logged into the peer-to-peer sports betting platform, the user would either create a bet or search for open bets.

An example of a user creating a bet is described next by reference to FIG. 1, which conceptually illustrates a bet creation process 100. When describing the bet creation process 100 of FIG. 1, reference is made to user interfaces for creating the bet in connection with FIGS. 3-8.

Turning first to FIG. 1, the bet creation process 100 starts when the user selects (at 105) a "create bet" tool, such as a tab, an option, etc. Next, the user selects (at 110) the sport on which to base the bet.

Figure 3:
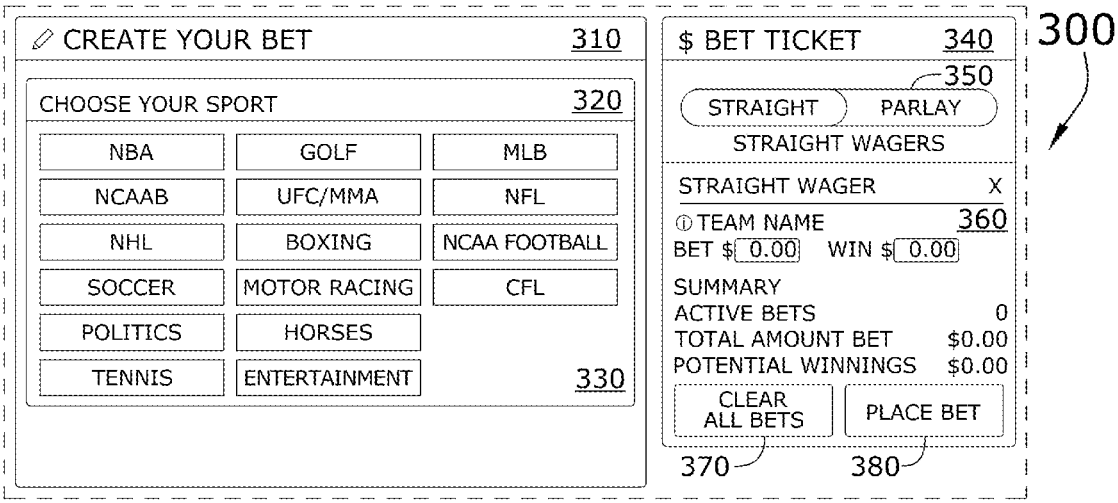
FIG. 3 conceptually illustrates a first bet creation user interface (UI) of a software application used to create a bet on a peer-to-peer sports betting platform of a multi-tiered personal wager creation and open wager matching system in some embodiments.

Now, turning to FIG. 3, which conceptually illustrates a bet creation user interface (UI) 310 and a bet ticket UI 340 of a software application used to create a bet on a peer-to-peer sports betting platform of a multi-tiered personal wager creation and open wager matching system in some embodiments. As shown in this figure, the bet creation UI 310 includes a sport selection UI 320 that visually outputs a plurality of selectable sports options 330. The bet ticket UI 340 includes a betting style toggle tool 350, a bet ticket information summary view 360, a clear all bets tool 370, and a place bets tool 380.

Thus, after the user selects the "create bet" tool (or tab in some views of the UI), the sport selection UI 320 gets populated with the plurality of selectable sports options 330. So, for example, the user may select the "NBA" button from the plurality of selectable sports options 330 to choose professional basketball as the sport for the bet the user is in the process of creating.

Figure 4:
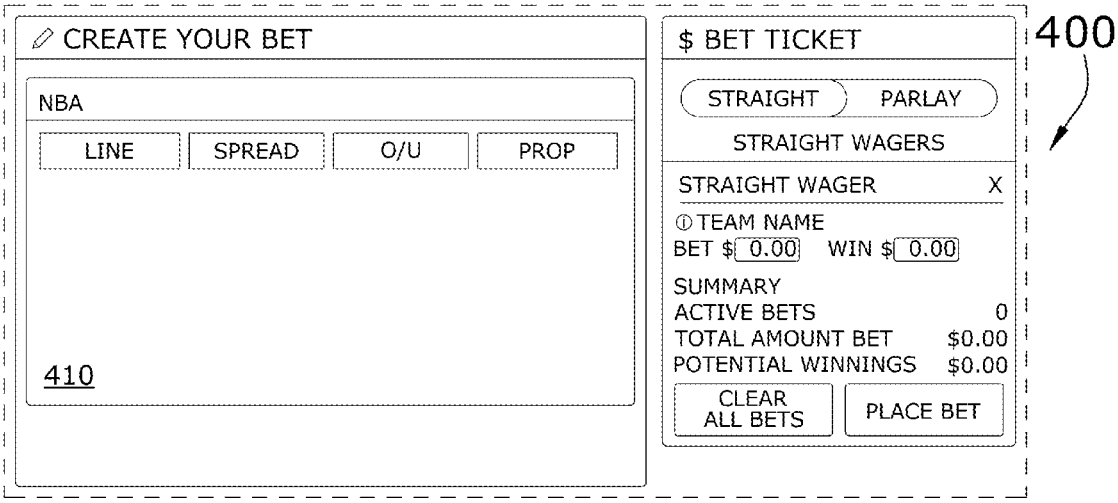
FIG. 4 conceptually illustrates a second bet creation UI of a software application used to create a bet on a peer-to-peer sports betting platform of a multi-tiered personal wager creation and open wager matching system in some embodiments.
Figure 5:
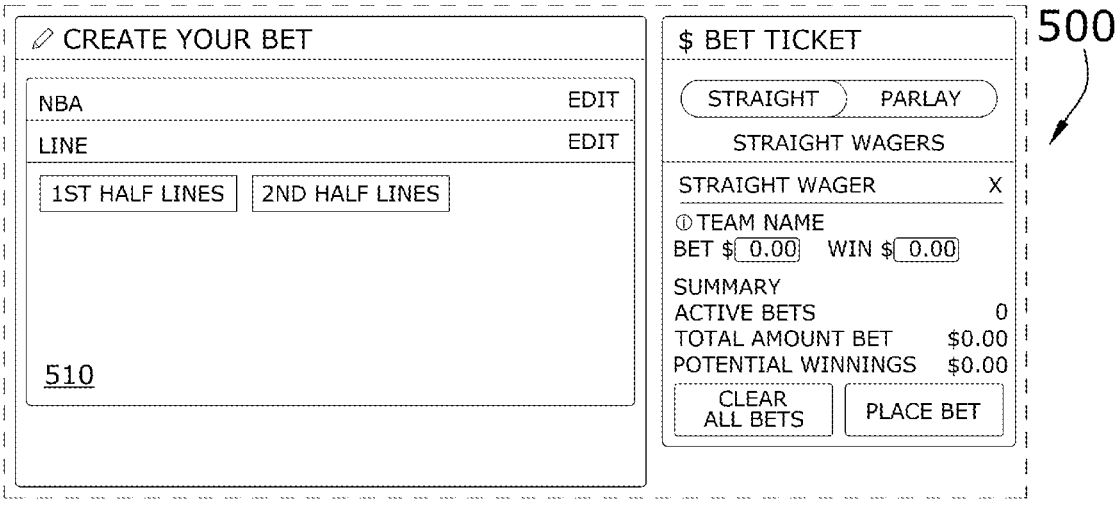
FIG. 5 conceptually illustrates a third bet creation UI of a software application used to create a bet on a peer-to-peer sports betting platform of a multi-tiered personal wager creation and open wager matching system in some embodiments.

After selection of a sport, more refined options are shown in the bet creation UI 310 to allow the user to further define and create the bet according to their own desires. This is shown in FIG. 4, which conceptually illustrates a second interface with additional items 400 in connection with the bet creation UI 310 and the bet ticket UI 340 of FIG. 3. Specifically, the second interface with additional items 400 shown in this figure includes a plurality of sport-specific betting types 410 comprising "line", "spread", "O/U" for over/under, and "prop". Also shown, the selected sport is shown as "NBA".

Now turning back to FIG. 1, the bet creation process 100 continues with the user selecting which type of bet (at 115). For instance, if the user selects "line" from the plurality of sport-specific betting types 410, then the user may have options to further refine details of the "line" type bet being created. This is show in FIG. 5, which conceptually illustrates a third interface with additional items 500 in connection with the bet creation UI 310 and the bet ticket UI 340 of FIG. 4. Specifically, the third interface with additional items 500 shown in this figure includes a plurality of betting type selections 510 comprising "1st half lines" and "2nd half lines". As these betting type selections pertain to basketball as the selected sport, it is appropriate to only have two halves of the game. On the other hand, if the user had selected football, the plurality of betting type selections may have shown "1st quarter lines", "2nd quarter lines", "3rd quarter lines", and "4th quarter lines". Similarly, if the selected sport was baseball, there may be lines shown for all nine innings of a baseball game.

Figure 6:
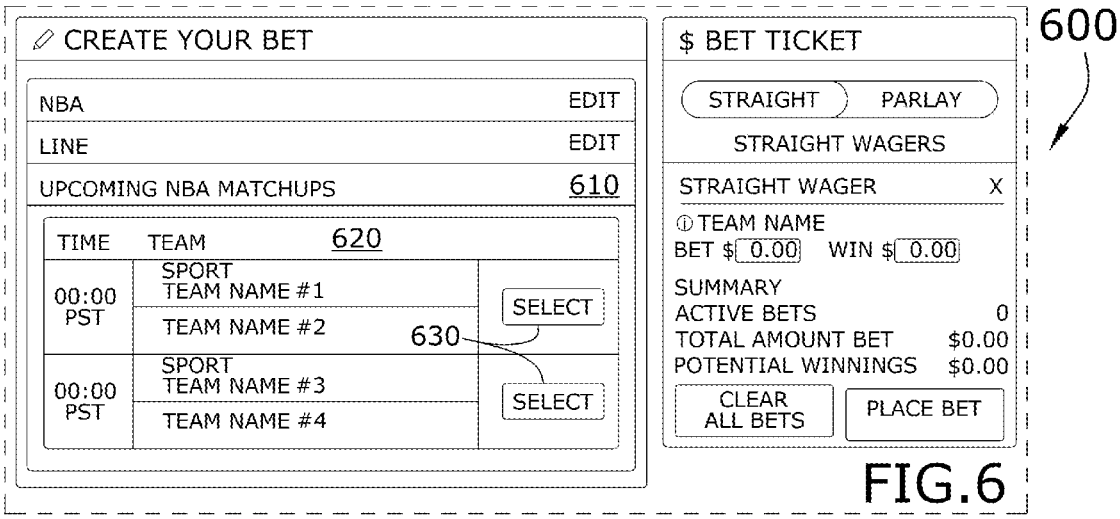
FIG. 6 conceptually illustrates a fourth bet creation UI of a software application used to create a bet on a peer-to-peer sports betting platform of a multi-tiered personal wager creation and open wager matching system in some embodiments.

Turning back to FIG. 1, after selecting the betting type (i.e., "line") and the betting type selection(s), the bet creation process 100 continues with the user selecting the game or player (at 120) for the bet being created. This is shown in FIG. 6, which conceptually illustrates a fourth interface with additional items 600 in connection with the bet creation UI 310 and the bet ticket UI 340 of FIG. 5. Specifically, the fourth interface with additional items 600 shown in this figure includes a sport-specific upcoming matches view 610 for basketball ("NBA" being selected in this example), an upcoming matches table 620 with a listing of upcoming matches as entries in the upcoming matches table 620, and a selection tool 630 for each upcoming match entry in the upcoming matches table 620. Once the user selects the desired match, the bet being created will be exclusively for the selected match. For example, if the user selects the match between "TEAM NAME #1" and "TEAM NAME #2", instead of the match between "TEAM NAME #3" and "TEAM NAME #4", then the bet being created will be a bet regarding the upcoming match between "TEAM NAME #1" and "TEAM NAME #2". The user can also select a player when it is appropriate for the sport selected. For example, if the user had selected golf as the sport on which to focus the bet being created, then the user may have been able to select a particular golfer as the player on which the bet is focused.

Turning back to FIG. 1, after selecting one of the upcoming matches (in this example, the upcoming match between "TEAM NAME #1" and "TEAM NAME #2"), the bet creation process 100 continues to the next step of determining (at 125) whether the user wants the bet being created to have Vegas odds or custom user-created odds. When Vegas odds are selected, the bet creation process 100 continues to the next step at which the user accepts the current Vegas odds (at 130). For instance, Vegas odds makers who publish Vegas odds may be used as the odds for this bet. On the other hand, when the user chooses to create the odds as custom, user-created odds, then the bet creation process 100 continues to an alternate step at which the user creates their own custom odds (at 135). Whether the user selected Vegas odds or custom, user-created odds, the bet creation process 100 then proceeds to the next step at which the user confirms the ticket (at 140).

Figure 7:
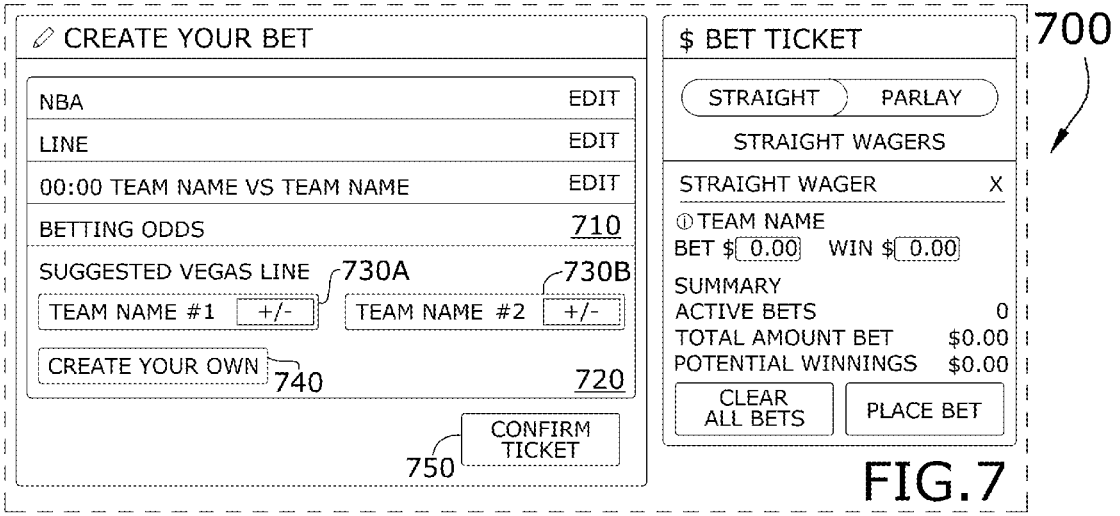
FIG. 7 conceptually illustrates a fifth bet creation UI of a software application used to create a bet on a peer-to-peer sports betting platform of a multi-tiered personal wager creation and open wager matching system in some embodiments.
Figure 8:
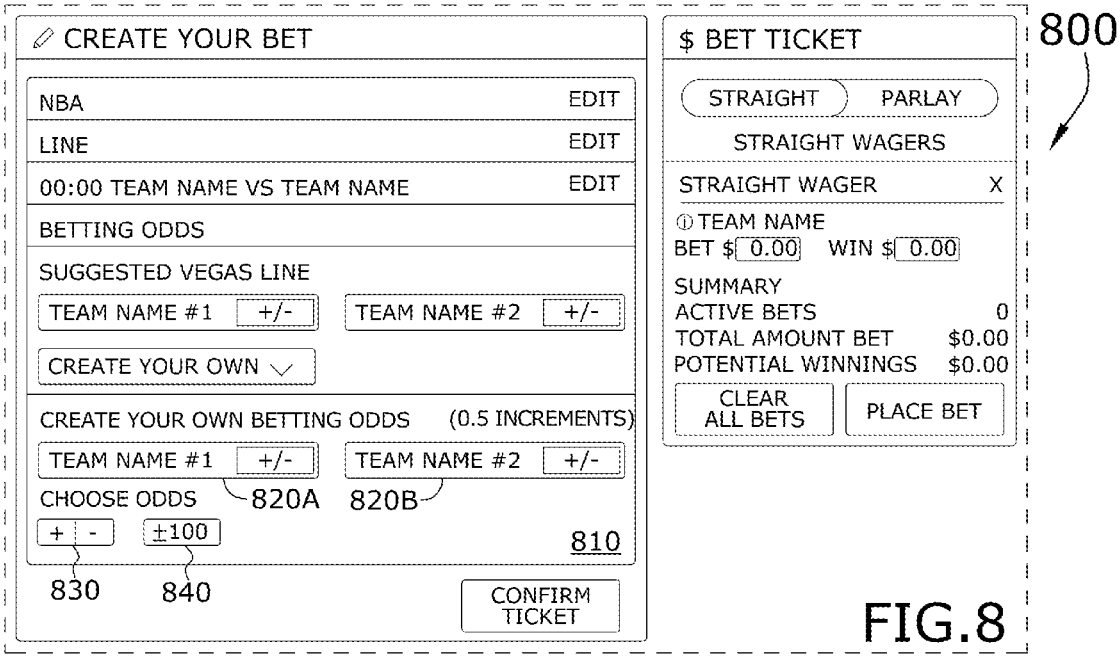
FIG. 8 conceptually illustrates a sixth bet creation UI of a software application used to create a bet on a peer-to-peer sports betting platform of a multi-tiered personal wager creation and open wager matching system in some embodiments.

The above-described several steps 125-135 of the bet creation process 100 are further described by reference to FIGS. 7-8. First, FIG. 7 conceptually illustrates a fifth interface with additional items 700 in connection with the bet creation UI 310 and the bet ticket UI 340 of FIG. 6. Specifically, the fifth interface with additional items 700 shown in this figure includes a betting odds selector view 710 that is associated with the betting type (i.e., "line" type betting). The betting odds selector view 710 shown here includes a plurality of betting type odds selection/creation tools 720 comprising suggested Vegas line tools 730A and 730B (for each team in the selected upcoming match—specifically, Vegas line tool 730A for "TEAM NAME #1" and Vegas line tool 730B for "TEAM NAME #2") and a custom odds creation tool 740 for the user to create his or her own odds. Furthermore, the fifth interface with additional items 700 shown in this figure also includes a confirm ticket tool 750 which, when selected by the user, confirms the selections to be placed in the bet ticket being created, details of which would be shown in the bet ticket UI 340 upon selection of the confirm ticket tool 750.

Now, if the user chooses to create custom odds, then the user would have selected the custom odds creation tool 740, which would trigger another interface. By way of example, FIG. 8 conceptually illustrates a sixth interface with additional items 800 in connection with the bet creation UI 310 and the bet ticket UI 340 of FIG. 7. Specifically, the sixth interface with additional items 800 shown in this figure includes a plurality of custom betting odds creation tools 810 comprising user-created custom line tools 820A and 820B (for each team in the selected upcoming match—specifically, user-created custom line tool 820A for "TEAM NAME #1" and user-created custom line tool 820B for "TEAM NAME #2"), an odds percent increment tool 830, and an odds percent numeric input tool 840. Then the user may select to confirm the bet ticket by selection of the confirm ticket tool 750.

Turning back to FIG. 1, the bet creation process 100 continues with the user confirming the bet ticket (at 140). For instance, when the user selects the confirm ticket tool 750 after completing the selections for the odds (e.g., Vegas odds or custom, user-created odds). Next, the bet creation process 100 proceeds to the next step at which the user places the bet (at 145). When the user places the bet by, for example, selection of the place bet tool 380, the user is simply putting the bet ticket shown in the bet ticket UI 340 into the pool of open bets. Thus, the bet creation process 100 continues with the user's bet being "active" in the "open bets" tab/view (at 150). An example of an "open bets" tab/view is described below, by reference to FIG. 9. Then the user can circle back to create more bets, or the bet creation process 100 of some embodiments ends.

Figure 2:
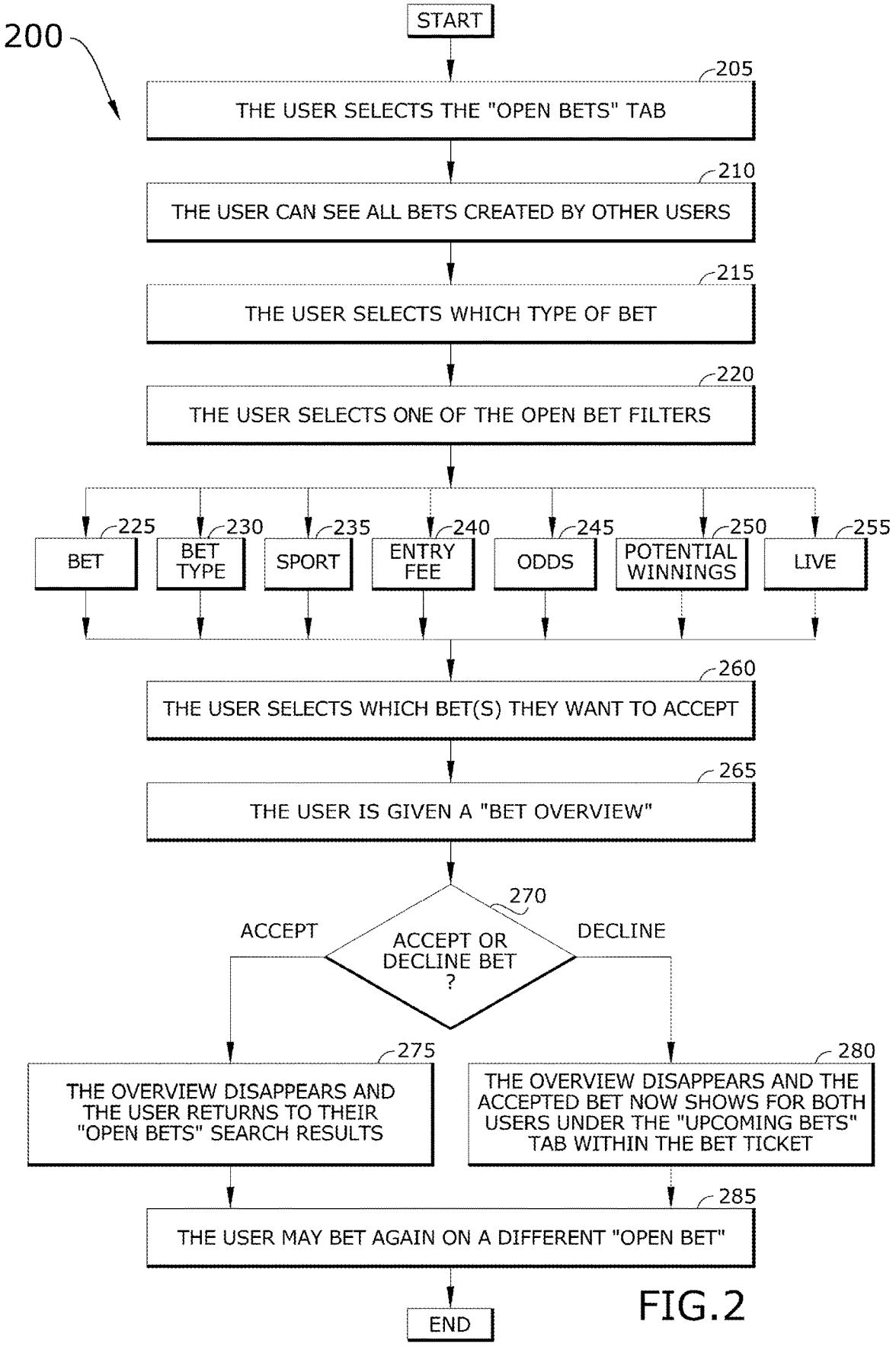
FIG. 2 conceptually illustrates an open bets process for viewing all open bets in some embodiments.

While the example user interfaces related to the bet creation process described above by reference to FIG. 1, in some embodiments there is a process for viewing open bets. This is demonstrated in FIG. 2, which conceptually illustrates an open bets process for viewing all open bets 200. Also, the open bets process for viewing all open bets 200 in this example is described by reference to FIGS. 9 and 10. Turning first to FIG. 2, the open bets process for viewing all open bets 200 starts when the user selects the "open bets" tab/view (at 205). Once selected, the open bets process for viewing all open bets 200 visually outputs all open bets so that the user is able see all bets created by themselves and by other users (at 210).

Figure 9:
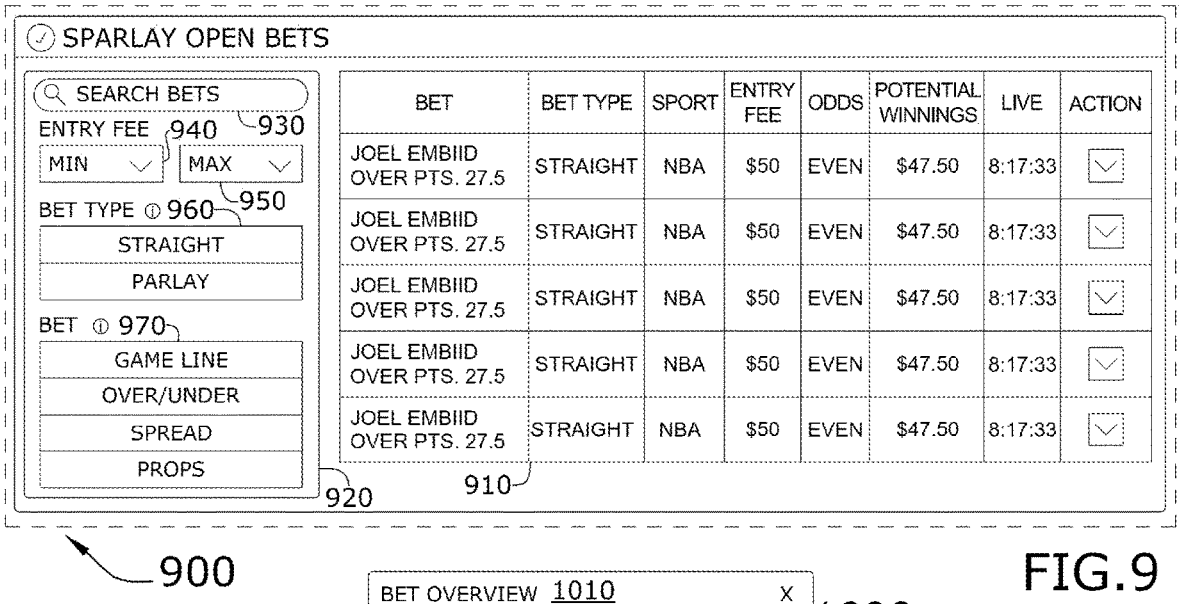
FIG. 9 conceptually illustrates an open bets search UI of a software application used to search for open bets on a peer-to-peer sports betting platform of a multi-tiered personal wager creation and open wager matching system in some embodiments.

Turning to an example view showing open bets, FIG. 9 conceptually illustrates an open bets search UI 900 of a software application used to search for open bets on a peer-to-peer sports betting platform of a multi-tiered personal wager creation and open wager matching system. As shown in this figure, the open bets search UI 900 includes an open bets table 910 and an open bets search tool 920. The open bets search tool 920 includes a plurality of search options and filters comprising a search input field 930 that takes textual input to match with information in one or more open bets, a minimum open bet amount tool 940, a maximum open bet amount tool 950, a bet style selection tool 960, and a bet type selection tool 970. The minimum open bet amount tool 940 and the maximum open bet amount tool 950 allow the user to define a monetary value range with which to constrain the search for open bets. After the user configures one or more of the plurality of search options and filters, then search for open bets returns a list of open bet entries in the open bets table 910. From the list of open bets in the open bets table 910, the user can select an open bet (e.g., double click on an entry field for one of the open bets in the search results) to review further details of the selected open bet and to either accept or decline the bet.

Figure 12:
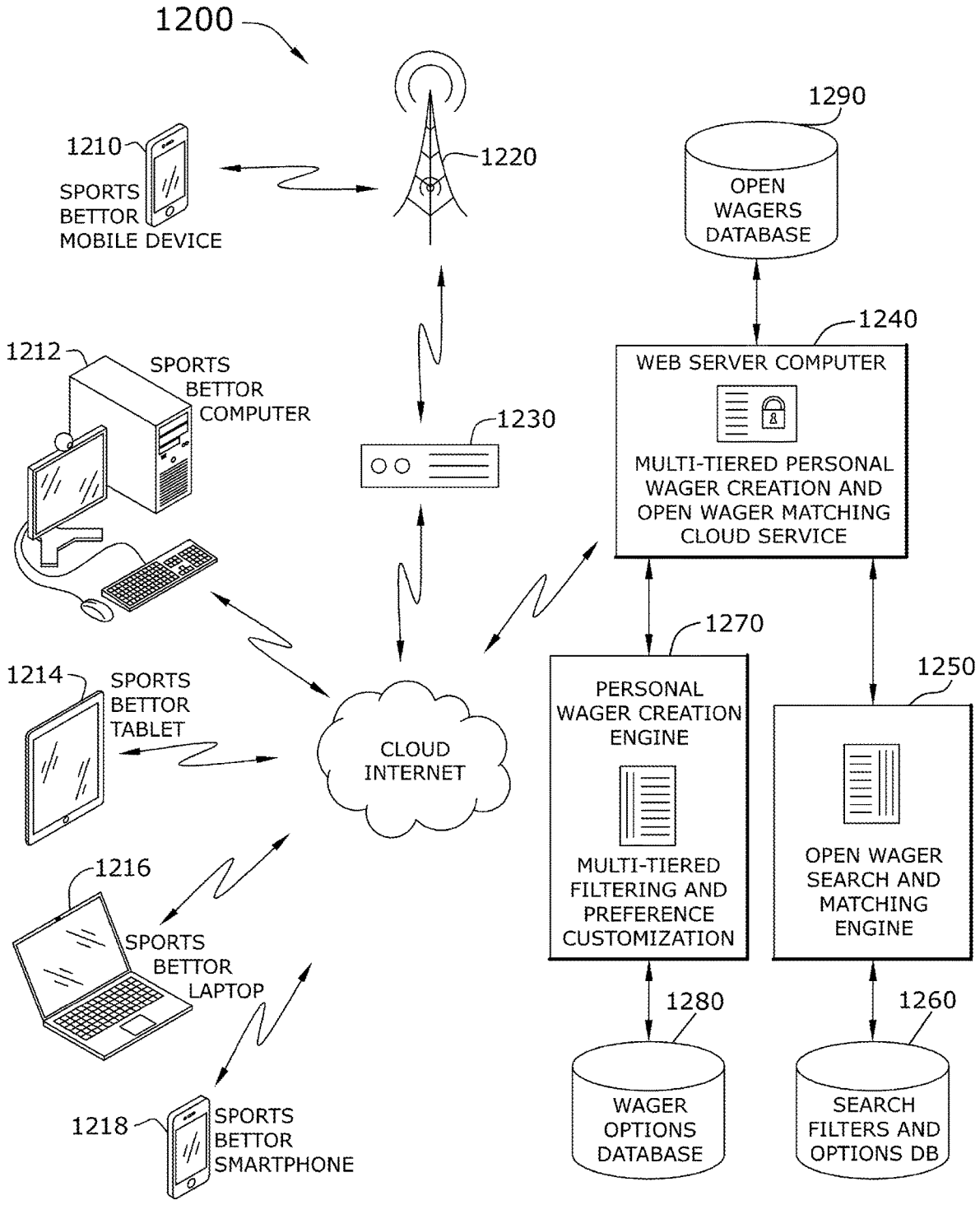
FIG. 12 conceptually illustrates a network architecture of a multi-tiered personal wager creation and open wager matching system in some embodiments.

Turning back to FIG. 2, the open bets process for viewing all open bets 200 continues with the user selecting which type of bet (at 215) and then selecting one or more of the open bet search options and filters (at 220). The bet search options and filters include, without limitation, bet input field, bet style, bet type, etc. Details of each open bet are shown in the resulting output (such as the open bets table 910 described above by reference to FIG. 9). In some embodiments, the details of each open bet are retrieved from an open bets database. An example of an open bets database is described in greater detail below by reference to FIG. 12. The details include, without limitation a bet identifier 225, a bet type 230 (e.g., straight or parlay), a sport 235 (as selected for the each open bet), an entry fee amount 240, an odds 245 (as created by the bet creation user or default to Vegas odds), a potential winnings amount 250, and a live (match) time 255. Next, the open bets process for viewing all open bets 200 continues with the user selecting which bet(s) to accept (at 260). In some embodiments, the open bets process for viewing all open bets 200 visually outputs a "bet overview" window or view (265) upon selection of a particular open bet. An example of a "bet overview" window or view is described next, by reference to FIG. 10.

Figure 10:
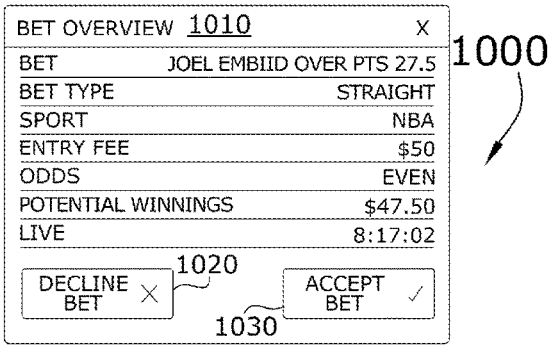
FIG. 10 conceptually illustrates a bet details window of a software application used to review details of open bets on a peer-to-peer sports betting platform of a multi-tiered personal wager creation and open wager matching system in some embodiments.

As noted above by reference to FIG. 9, selection of an individual open bet from the open bets table 910 shown in the open bets search UI 900 is demonstrated in and described by reference to FIG. 10, which conceptually illustrates a bet details window 1000 of the software application used to review details of open bets on the peer-to-peer sports betting platform of the multi-tiered personal wager creation and open wager matching system. As shown in this figure, the bet details window 1000 includes a bet overview 1010 area in which details of the selected open bet are presented. The details of the selected open bet include, as noted above and without limitation, the bet identifier 225, the bet type 230, the sport 235, the entry fee amount 240, the odds 245, the potential winnings amount 250, and the live (match) time 255. In some embodiments, the details of the selected open bet are retrieved from an open bets database. Furthermore, the bet details window 1000 includes a decline bet selection tool 1020 and an accept bet selection tool 1030. When the user selects the decline bet selection tool 1020, the user is taken back to the open bets search UI 900 with the prior search results shown in the open bets table 910 as before selection of the particular open bet entry. In some embodiments, when the user selects the accept bet selection tool 1030, the user taken to an "upcoming bets" view or tab. An example of an "upcoming bets" view or tab is described further below, by reference to FIG. 11. In some other embodiments, when the user selects the accept bet selection tool 1030, the user is again taken back to the open bets search UI 900 with the prior search results shown in the open bets table 910, so as to allow the user to select more open bets to accept (or decline).

Turning back to FIG. 2, the open bets process for viewing all open bets 200 continues to the next step of determining (at 270) whether the user has selected to accept or decline the open bet displayed in the "bet overview" window or view (i.e., the bet details window 1000). When the user selected to decline the open bet, then the open bets process for viewing all open bets 200 continues to the next step (at 275) during which the overview disappears and the user returns to the open bets search results. On the other hand, when the user selected to accept the open bet, then the open bets process for viewing all open bets 200 continues to the next step (at 280) during which the overview disappears and the accepted bet now shows for both users (bet creation user and bet accepting user) under an "upcoming bets" tab or view within the bet ticket. An example of an "upcoming bets" tab/view is described below by reference to FIG. 11.

In some embodiments, whether the user has declined or accepted the open bet, the open bets process for viewing all open bets 200 returns to the open bets view with the open bets table such that the user may bet again on a different open bet (at 285). Then the open bets process for viewing all open bets 200 ends. As a person skilled in the relevant art would appreciate, the steps of the open bets process for viewing all open bets 200 may be repeated or interchangeably repeated before ending, and may continue for as many bets accepted or declined as desired by the user.

Figure 11:
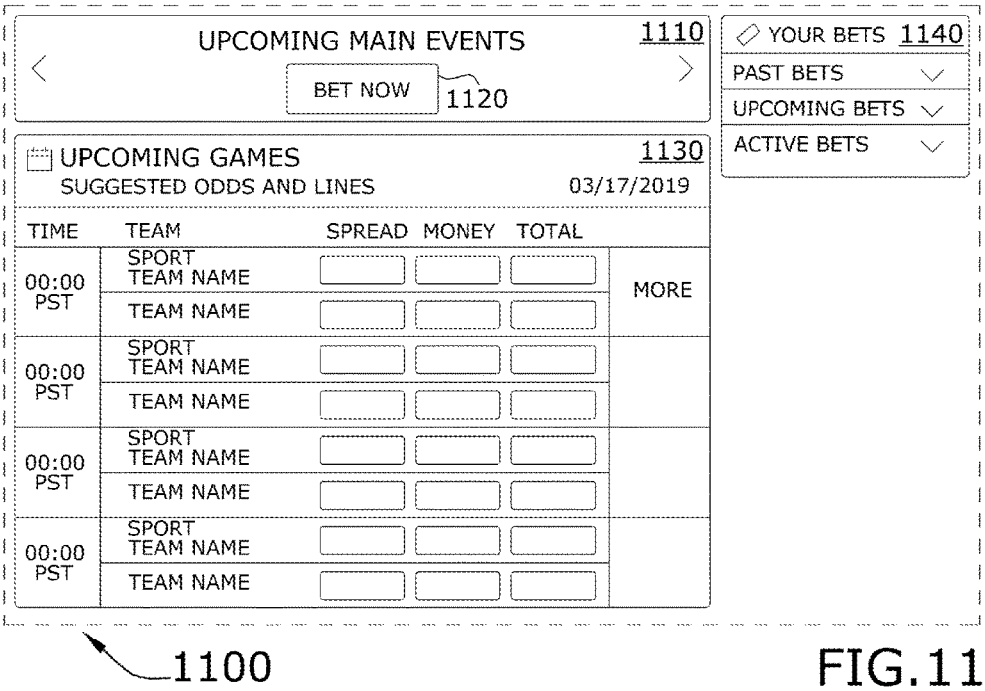
FIG. 11 conceptually illustrates an events view UI of a software application used to view upcoming events on which bets can be created on a peer-to-peer sports betting platform of a multi-tiered personal wager creation and open wager matching system in some embodiments.

Now, by way of example, FIG. 11 conceptually illustrates an events view UI 1100 of a software application used to view upcoming events in which "upcoming bets" are visually output for a bet accepting user and each associated bet creating user who created any of the upcoming bets accepted by the bet accepting user. As shown here, the events view UI 1100 includes an upcoming events view 1110 and a bet now tool 1120. A table of upcoming events 1130 associated with upcoming bets of the user is shown further down the events view UI 1100. Furthermore, a user bets menu 1140 is shown in the events view UI 1100 which allows the user to view past bets, upcoming bets, and active bets. In this way, the user is able to manage bets he or she created as well as bets he or she accepted.

While the above examples pertained to peer-to-peer sports betting processes and example user interfaces for user interaction in connection with creating bets and viewing open bets (to accept or decline), some embodiments include a multi-tiered personal wager creation and open wager matching system. By way of example, FIG. 12 conceptually illustrates a network architecture of a multi-tiered personal wager creation and open wager matching system 1200. As shown in this figure, the multi-tiered personal wager creation and open wager matching system 1200 includes a sports bettor mobile device 1210, a sports bettor computer 1212, a sports bettor tablet computing device 1214, a sports bettor laptop computer 1216, and a sports bettor smartphone 1218. The multi-tiered personal wager creation and open wager matching system 1200 also includes a wireless communication point 1220 (e.g., a cell tower for cellular data communication), a gateway 1230, a web server 1240 that hosts a multi-tiered personal wager creation and open wager matching cloud service, an open wager search and matching engine 1250, a search filters and options database 1260, a personal wager creation engine 1270 with multi-tiered filtering and preference customization, a wager options database 1280, and an open wagers database 1290. The example user interfaces for user interaction in connection with creating bets and viewing open bets, described above by reference to FIGS. 3-11, and other exemplary user interfaces are visually output onto screens of the sports bettor mobile device 1210, the sports bettor computer 1212, the sports bettor tablet computing device 1214, the sports bettor laptop computer 1216, and the sports bettor smartphone 1218 when connected to the web server 1240 that hosts the multi-tiered personal wager creation and open wager matching cloud service. Open bet data, active bet data, and past bet data is also retrieved, by user directed selections when connected to the web server 1240.

Many of the above-described features and applications are implemented as software processes that are specified as a set of instructions recorded on a computer readable storage medium (also referred to as computer readable medium or machine readable medium). When these instructions are executed by one or more processing unit(s) (e.g., one or more processors, cores of processors, or other processing units), they cause the processing unit(s) to perform the actions indicated in the instructions. Examples of computer readable media include, but are not limited to, CD-ROMs, flash drives, RAM chips, hard drives, EPROMs, etc. The computer readable media does not include carrier waves and electronic signals passing wirelessly or over wired connections.

In this specification, the term "software" is meant to include firmware residing in read-only memory or applications stored in magnetic storage, which can be read into memory for processing by a processor. Also, in some embodiments, multiple software inventions can be implemented as sub-parts of a larger program while remaining distinct software inventions. In some embodiments, multiple software inventions can also be implemented as separate programs. Finally, any combination of separate programs that together implement a software invention described here is within the scope of the invention. In some embodiments, the software programs, when installed to operate on one or more electronic systems, define one or more specific machine implementations that execute and perform the operations of the software programs.

Figure 13:
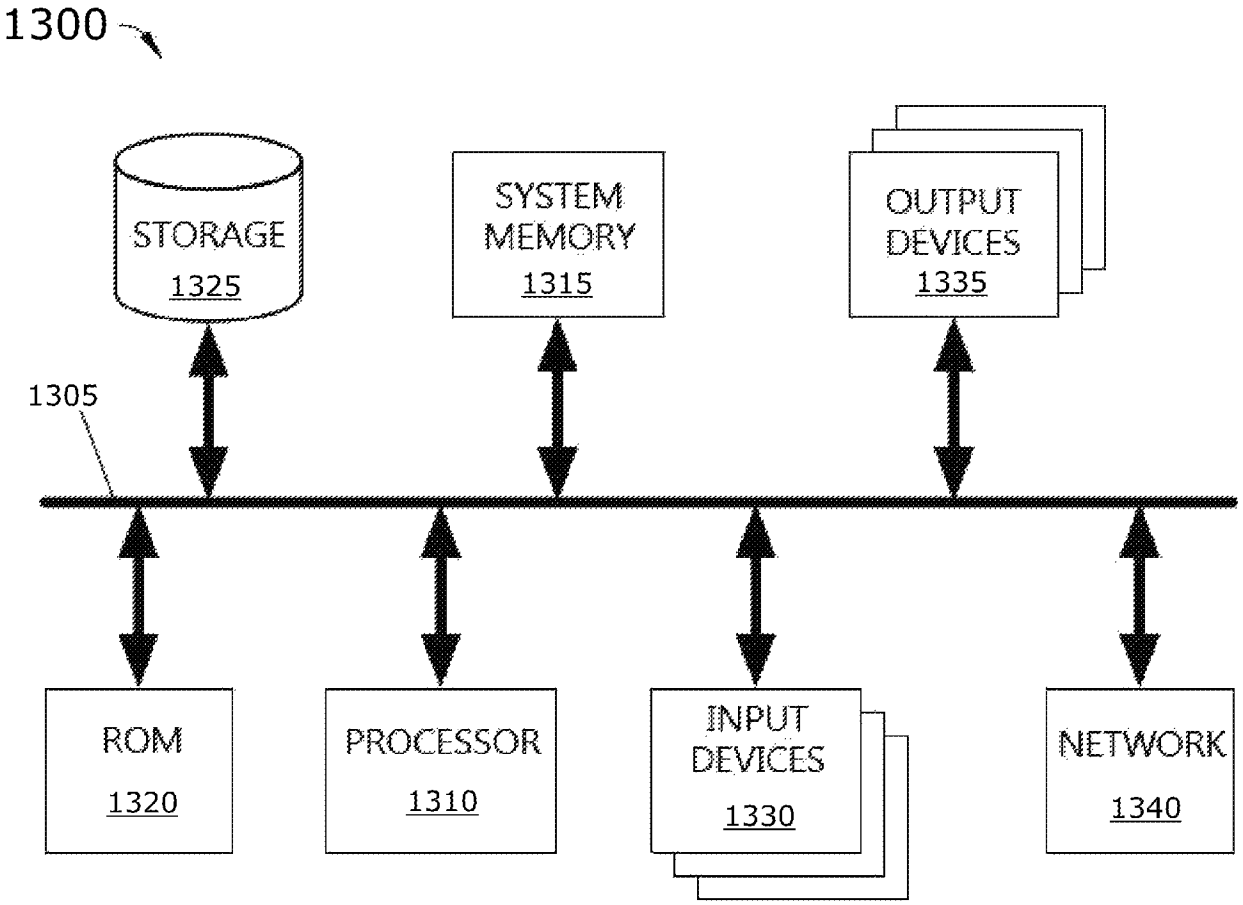
FIG. 13 conceptually illustrates an electronic system with which some embodiments of the invention are implemented.

FIG. 13 conceptually illustrates an electronic system 1300 with which some embodiments of the invention are implemented. The electronic system 1300 may be a computer, phone (cell phone, mobile phone, smartphone, etc.), PDA (iPod, other handheld computing device, etc.), or any other sort of electronic device or computing device. Such an electronic system includes various types of computer readable media and interfaces for various other types of computer readable media. Electronic system 1300 includes a bus 1305, processing unit(s) 1310, a system memory 1315, a read-only 1320, a permanent storage device 1325, input devices 1330, output devices 1335, and a network 1340.

The bus 1305 collectively represents all system, peripheral, and chipset buses that communicatively connect the numerous internal devices of the electronic system 1300. For instance, the bus 1305 communicatively connects the processing unit(s) 1310 with the read-only 1320, the system memory 1315, and the permanent storage device 1325.

From these various memory units, the processing unit(s) 1310 retrieves instructions to execute and data to process in order to execute the processes of the invention. The processing unit(s) may be a single processor or a multi-core processor in different embodiments.

The read-only-memory (ROM) 1320 stores static data and instructions that are needed by the processing unit(s) 1310 and other modules of the electronic system. The permanent storage device 1325, on the other hand, is a read-and-write memory device. This device is a non-volatile memory unit that stores instructions and data even when the electronic system 1300 is off. Some embodiments of the invention use a mass-storage device (such as a magnetic or optical disk and its corresponding disk drive) as the permanent storage device 1325.

Other embodiments use a removable storage device (such as a floppy disk or a flash drive) as the permanent storage device 1325. Like the permanent storage device 1325, the system memory 1315 is a read-and-write memory device. However, unlike storage device 1325, the system memory 1315 is a volatile read-and-write memory, such as a random access memory. The system memory 1315 stores some of the instructions and data that the processor needs at runtime. In some embodiments, the invention's processes are stored in the system memory 1315, the permanent storage device 1325, and/or the read-only 1320. For example, the various memory units include instructions for processing appearance alterations of displayable characters in accordance with some embodiments. From these various memory units, the processing unit(s) 1310 retrieves instructions to execute and data to process in order to execute the processes of some embodiments.

The bus 1305 also connects to the input and output devices 1330 and 1335. The input devices enable the user to communicate information and select commands to the electronic system. The input devices 1330 include alphanumeric keyboards and pointing devices (also called "cursor control devices"). The output devices 1335 display images generated by the electronic system 1300. The output devices 1335 include printers and display devices, such as cathode ray tubes (CRT) or liquid crystal displays (LCD). Some embodiments include devices such as a touchscreen that functions as both input and output devices.

Finally, as shown in FIG. 13, bus 1305 also couples electronic system 1300 to a network 1340 through a network adapter (not shown). In this manner, the computer can be a part of a network of computers (such as a local area network ("LAN"), a wide area network ("WAN"), or an intranet), or a network of networks (such as the Internet). Any or all components of electronic system 1300 may be used in conjunction with the invention.

These functions described above can be implemented in digital electronic circuitry, in computer software, firmware or hardware. The techniques can be implemented using one or more computer program products. Programmable processors and computers can be packaged or included in mobile devices. The processes may be performed by one or more programmable processors and by one or more set of programmable logic circuitry. General and special purpose computing and storage devices can be interconnected through communication networks.

Some embodiments include electronic components, such as microprocessors, storage and memory that store computer program instructions in a machine-readable or computer-readable medium (alternatively referred to as computer-readable storage media, machine-readable media, or machine-readable storage media). Some examples of such computer-readable media include RAM, ROM, read-only compact discs (CD-ROM), recordable compact discs (CD-R), rewritable compact discs (CD-RW), read-only digital versatile discs (e.g., DVD-ROM, dual-layer DVD-ROM), a variety of recordable/rewritable DVDs (e.g., DVD-RAM, DVD-RW, DVD+RW, etc.), flash memory (e.g., SD cards, mini-SD cards, micro-SD cards, etc.), magnetic and/or solid state hard drives, read-only and recordable Blu-Ray® discs, ultra density optical discs, any other optical or magnetic media, and floppy disks. The computer-readable media may store a computer program that is executable by at least one processing unit and includes sets of instructions for performing various operations. Examples of computer programs or computer code include machine code, such as is produced by a compiler, and files including higher-level code that are executed by a computer, an electronic component, or a microprocessor using an interpreter.

While the invention has been described with reference to numerous specific details, one of ordinary skill in the art will recognize that the invention can be embodied in other specific forms without departing from the spirit of the invention. For instance, FIGS. 1 and 2 conceptually illustrate processes in which the specific operations of the process may not be performed in the exact order shown and described. Specific operations may not be performed in one continuous series of operations, and different specific operations may be performed in different embodiments. Furthermore, each process could be implemented using several sub-processes, or as part of a larger macro process. Thus, one of ordinary skill in the art would understand that the invention is not to be limited by the foregoing illustrative details, but rather is to be defined by the appended claims.

I claim:

1. An open bets process for viewing all open bets comprising:

connecting, over a network by a client computing device operated by a user, to a peer-to-peer sports betting platform of a multi-tiered personal wager creation and open wager matching system;

visually outputting, on a display of the client computing device operated by the user, an open bets viewing and bet creation user interface (UI) that is used to search for open bets and create bets on the peer-to-peer sports betting platform of the multi-tiered personal wager creation and open wager matching system, wherein the open bets viewing and bet creation UI comprises a selectable open bets view and a selectable create bets view;

receiving a selection within the open bets viewing and bet creation UI, by the user operating the client computing device, of the open bets view;

visually outputting, on the display of the client computing device operated by the user, an open bets search UI comprising an open bets search tool and an open bets table that lists a set of all open bets that is filtered by search criteria specified in connection with the open bets search tool, wherein the open bets search tool comprises a search input field and a plurality of open bets filtering tools comprising a minimum open bet amount tool, a maximum open bet amount tool, a bet style selection tool, and a bet type selection tool, wherein the search criteria specified in connection with the open bets search tool for any search of open bets comprises at least one of a textual input entered by the user into the search input field and a filter option specified by user interaction with a least one of the plurality of open bets filtering tools;

receiving a selection, by the user, of the bet type selection tool from the open bets search UI;

selecting, by way of the user interacting with the bet type selection tool, a type of bet;

retrieving, by an open wager search and matching engine querying an open wagers database that is communicably connected to a web server computing device of the multi-tiered personal wager creation and open wager matching system, a plurality of bet details for each open bet in the set of all open bets that match the type of bet;

listing the set of all open bets that match the type of bet in the open bets table;

visually outputting, on the display of the client computing device, the open bets table listing the set of all open bets that match the type of bet;

filtering the set of all open bets that match the type of bet based on the search criteria specified in connection with the open bets search tool, wherein the search criteria comprises any textual input entered into the search input field by the user and any filter option specified by user interaction with any tool in the plurality of open bets filtering tools;

updating the open bets table listing based on the filtered set of all open bets that match the type of bet and search criteria;

visually outputting, on the display of the client computing device, the open bets table listing the filtered set of all open bets that match the type of bet and the search criteria;

receiving a selection, by the user, of a particular bet in the filtered set of all open bets that match the type of bet and the search criteria;

retrieving the plurality of bet details for the particular bet;

visually outputting, on the display of the client computing device, the retrieved bet details for the particular bet in a bet details window that overlays the open bets search UI, wherein the bet details window comprises a bet overview area, an accept bet tool, and a decline bet tool, wherein the retrieved bet details for the particular bet are displayed in the bet overview area of the bet details window; and receiving a selection, by the user, of only one of the accept bet tool and the decline bet tool from the bet details window in connection with the particular bet.

2. The open bets process for viewing all open bets of claim 1, wherein the user is a first user, wherein receiving the selection of the accept bet tool comprises:

removing, from the display of the client computing device, the bet details window that overlays the open bets search UI;

adding, by a personal wager creation engine of the multi-tiered personal wager creation and open wager matching system, the particular bet to a first user list of upcoming bets associated with the first user;

adding, by the personal wager creation engine of the multi-tiered personal wager creation and open wager matching system, the particular bet to a second user list of upcoming bets associated with a second user who created the particular bet; and visually outputting, on the display of the client computing device, the first list of upcoming bets associated with the first user.

3. The open bets process for viewing all open bets of claim 1, wherein receiving the selection of the decline bet tool further comprises removing, from the display of the client computing device, the bet details window that overlays the open bets search UI.

4. The open bets process for viewing all open bets of claim 1, wherein the plurality of bet details for each open bet in the set of all open bets comprises a bet identifier, a bet type, a sport associated with the bet, an entry fee, odds for the bet, potential winnings of the bet, and a live match time associated with the bet.

5. The open bets process for viewing all open bets of claim 1, wherein the web server computing device hosts a multi-tiered personal wager creation and open wager matching cloud service to which the client computing device connects.

6. A bet creation process comprising:

connecting, over a network by a client computing device operated by a user, to a peer-to-peer sports betting platform of a multi-tiered personal wager creation and open wager matching system;

visually outputting, on a display of the client computing device operated by the user, an open bets viewing and bet creation user interface (UI) that is used to search for open bets and create bets on the peer-to-peer sports betting platform of the multi-tiered personal wager creation and open wager matching system, wherein the open bets viewing and bet creation UI comprises a selectable open bets view and a selectable create bets view;

receiving a selection within the open bets viewing and bet creation UI, by the user operating the client computing device, of the create bets view;

visually outputting, on the display of the client computing device operated by the user, an interface to create new bets and view created bets, wherein the interface comprises a bet creation UI and a bet ticket UI that presents a plurality of bet options and tools, wherein the bet creation UI presents an interactive sequence of user-selectable options for creating a new bet, wherein a first option in the interactive sequence of user-selectable options comprises a sport selection view;

receiving a selection, by the user, of a particular sport from a plurality of sports displayed in the sport selection view, said particular sport selected by the user to create a bet to place in an open bets pool (i) managed by a multi-tiered personal wager creation and open wager matching service hosted by a web server computing device of the multi-tiered personal wager creation and open wager matching system and (ii) associated with open bets stored in an open wagers database that is communicably connected to the web server computing device of the multi-tiered personal wager creation and open wager matching system;

visually outputting, on the display of the client computing device, a bet type selection view as a second option in the interactive sequence of user-selectable options;

receiving a selection, by the user, of a particular type of bet from a plurality of bet types displayed in the bet type selection view, said particular type of bet associated with the bet to place in the open bets pool;

visually outputting, on the display of the client computing device, a match selection view as a third option in the interactive sequence of user-selectable options, wherein the match selection view comprises an upcoming matches table with a listing of upcoming matches for the particular sport and a match selection tool for each upcoming match listed in the upcoming matches table;

receiving a selection, by the user, of a particular match in the listing of upcoming matches for the bet to place in the open bets pool;

visually outputting, on the display of the client computing device, a betting odds selector view as a fourth option in the interactive sequence of user-selectable options;

receiving input, by the user via the client computing device, to set the odds for the bet to place in the open bets pool;

receiving a selection, by the user via the client computing device, of a confirm bet ticket tool in the bet creation UI to aggregate the particular sport, the particular type of bet, the particular match, and the odds for the bet within a particular user-generated bet and activate the particular user-generated bet in the open bets pool;

transmitting, by the client computing device upon receiving the selection of the confirm bet ticket tool, the particular user-generated bet to the web server computing device of the multi-tiered personal wager creation and open wager matching system;

storing, by the web server computing device, the particular user-generated bet in the open wagers database of the multi-tiered personal wager creation and open wager matching system; and activating, by the multi-tiered personal wager creation and open wager matching service, the particular user-generated bet in the open bets pool.

7. The bet creation process of claim 6, wherein receiving input to set the odds for the bet comprises receiving a selection, by the user, of a default Vegas odds option that sets odds for the bet to published Vegas odds.

8. The bet creation process of claim 6, wherein receiving input to set the odds for the bet comprises setting, by the user, custom odds defined by the user for the bet to place in the open bets pool.

9. The bet creation process of claim 6, wherein the type of bet associated with the bet comprises one of a straight bet and a parlay bet.

10. The bet creation process of claim 6, wherein the type of bet associated with the bet comprises one of a line bet, a spread bet, an over-under bet, and a prop bet.

* * * * *